United States Patent [19]

Hudson, Jr.

[11] Patent Number: 4,805,564

[45] Date of Patent: Feb. 21, 1989

[54] ENGINE INTAKE MANIFOLD ASSEMBLY

[75] Inventor: Sharon J. Hudson, Jr., Lambertville, Mich.

[73] Assignee: Sharon Manufacturing Company, Lambertville, Mich.

[21] Appl. No.: 99,591

[22] Filed: Sep. 22, 1987

[51] Int. Cl.[4] ..... F02M 61/14

[52] U.S. Cl. ..... 123/52 MC; 123/470

[58] Field of Search ..... 123/52 M, 52 MC, 52 MV, 123/468, 469, 470

[56] References Cited

U.S. PATENT DOCUMENTS

| | | | |
|---|---|---|---|
| 4,286,563 | 9/1981 | Fahim et al. | 123/469 |
| 4,341,186 | 7/1982 | Mayr et al. | 123/52 M |
| 4,386,586 | 6/1983 | Santiago et al. | 123/52 M |
| 4,516,538 | 5/1985 | Arakawa et al. | 123/52 M |
| 4,519,368 | 5/1985 | Hudson | 123/470 |
| 4,556,034 | 12/1985 | Anklam et al. | 123/470 |
| 4,589,381 | 5/1986 | Takayama | 123/52 M |
| 4,702,202 | 10/1987 | Hensel et al. | 123/52 M |
| 4,719,879 | 1/1988 | Kato et al. | 123/52 M |
| 4,735,177 | 4/1988 | Koike | 123/52 M |

FOREIGN PATENT DOCUMENTS 0181964 11/1982 Japan ..... 123/52 M

*Primary Examiner*—David A. Okonsky

*Attorney, Agent, or Firm*—Harold F. Mensing

[57] ABSTRACT

An intake manifold assembly comprising sheet metal top and bottom members which define an air intake throat section, a plenum section and a plurality of hollow runners extending from the plenum section to a ported manifold mounting plate integrally attached to the distal ends of the runners. A throttle valve assembly insert is contained in or on the throat section and provided with a passageway for circulating a heating fluid. Provisions are also made for various sensing and control functions. In addition a fuel supply rail, having a number of fuel injector receptacles for holding and supplying fuel to a plurality of separate electromagnetic fuel injectors, is integrally attached to the top of the manifold over the distal ends of the runners. The receptacles each have open top and bottom ends and are attached such that their open bottom ends are in fluid communication with the interior of the runners. The component parts are bonded together by copper bracing in a controlled atmosphere furnace.

21 Claims, 4 Drawing Sheets

ENGINE INTAKE MANIFOLD ASSEMBLY

FIELD OF THE INVENTION

This invention relates to an intake manifold for an internal combustion engine. More specifically it relates to an intake manifold assembly which includes an integrally attached fuel rail and an integrated throttle valve body insert.

BACKGROUND OF THE INVENTION

Numerous prior art attempts have been made to incorporate into an intake manifold unit, as many as possible of the functional components and features required to efficiently produce properly mixed charges of fuel and air and to make these charges readily available to the combustion chambers of an internal combustion engine. In most of the attempts only a limited success was achieved. In some instances integrating the desired components and features into a single assembly, involved intricate, complex or exotic manufacturing procedures which made such units practically impossible to mass produce or too costly to do so. In other instances where the component parts were designed so it was possible to incorporate them into an intake manifold that could be mass produced, the efficiencies of the components were compromised. Accordingly it is a general object of this invention to provide an improved intake manifold assembly which combines a maximum number of related fuel system components, provides for various operating controls, lends itself to mass production techniques and does so without compromising the efficiencies of its functional components.

SUMMARY OF THE INVENTION

The improved intake manifold assembly disclosed herein comprises sheet metal top and bottom members formed by stamping processes so as to define an air intake throat section, a plenum section and a plurality of hollow runners extending from one side of the plenum section to a ported manifold mounting plate containing the exit end of the runners. A throttle valve assembly containing a throttle plate is encased in the air intake throat section. Preferably the body portion of the throttle valve assembly is made of pressed and sintered powdered metal and provided with a fluid passageway for the circulation of a heating fluid. Provisions are made also for the introduction of engine crankcase fumes into the manifold and for various sensing and control functions including a fresh air by-pass around the throttle valve. In addition a fuel supply rail, having a plurality of receptacles for removably holding a like number of separate electromagnetic fuel injectors, is integrally attached to the runners adjacent to their manifold mounting plate ends. The injector receptacles have open bottom ends which are in fluid communication with the interior of the runners. The components are designed for simplified assembly and have means whereby they can be positioned easily and precisely relative to one another and bonded together into a unit preferably by copper brazing in a controlled atmosphere furnace. These features and other details, relationships and advantages of the invention will be understood best if the following description is read in conjunction with the accompanying drawings.

DETAILED DESCRIPTION OF THE INVENTION

Figure 1:
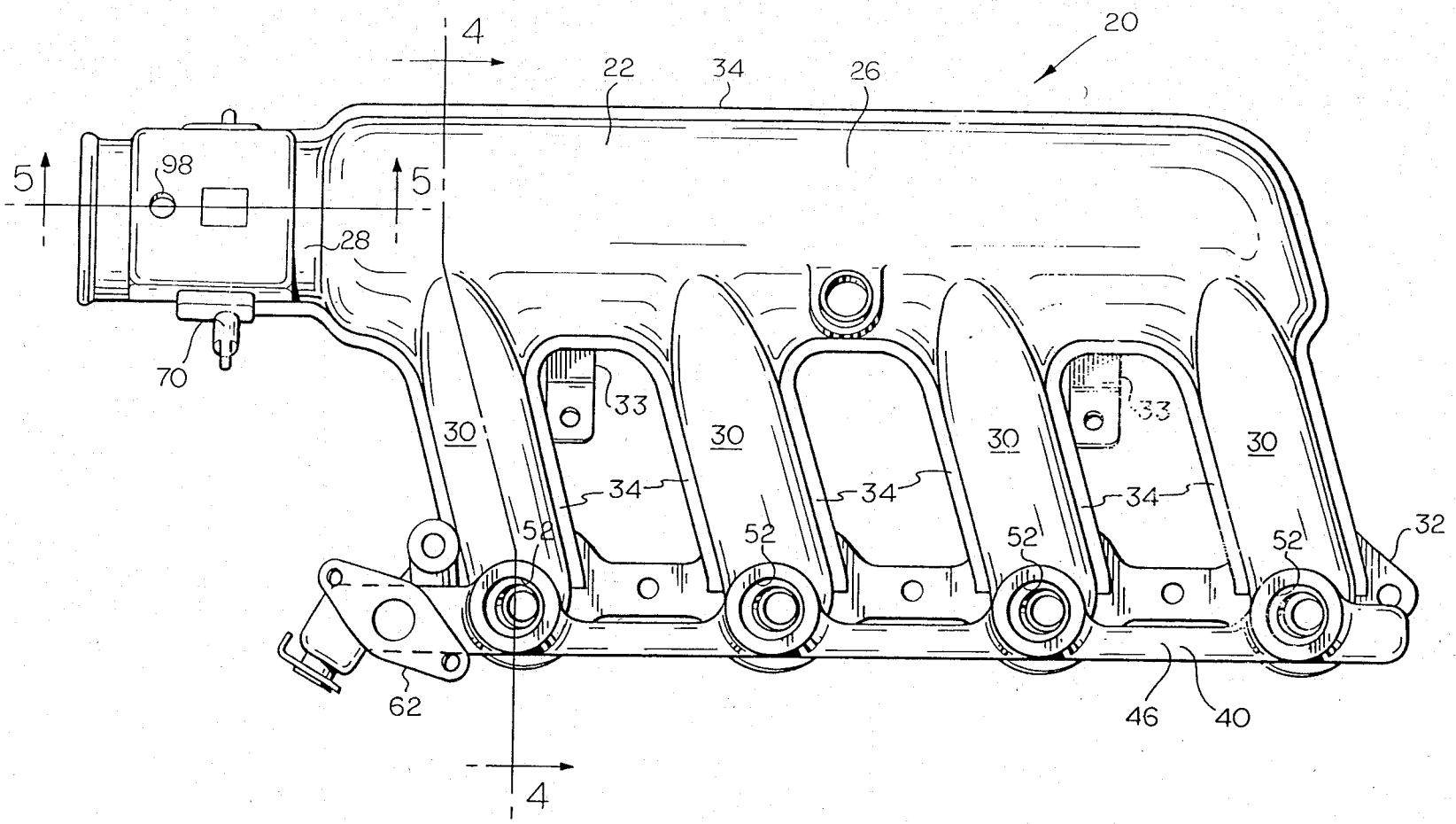
FIG.1 is a plan view of a preferred embodiment of an intake manifold assembly made in accordance with the teachings of this invention.

Referring to the drawings it will be noted that the manifold intake assembly 20 is comprised of top 22 and bottom 24 members made of laminar or sheet material, such as sheet metal, which have been formed by stamping processes so as to jointly define an elongated hollow plenum section 26, an air entry or throat section 28 at one end of the plenum section and a plurality of open ended tubular runners 30 which extend from one side of the plenum section to a ported manifold mounting plate 32. Although the illustrated embodiments are designed for use on a four cylinder in-line internal combustion engine, the teachings of this invention can be readily applied to other engines having more or fewer cylinders including V-type engines having two banks of cylinders. The elongated plenum section 26 has a generally circular cross section of substantially uniform size except for streamlined sections which merge wit and are integrally connected to the adjacent open ends of the runners. The intake assembly 20 is secured to and supported on the engine by means of the mounting plate 32 and a pair of laterally spaced apart angular brackets 33 each of which is affixed at one end to the underside of the plenum section 26 of bottom member 24 The top and bottom members are provided with laterally disposed peripheral flange sections 34 which extend around the plenum and runners except where the periphery is interrupted by openings, such as at the exit ends of the runners or the intake throat opening. Preferably the flange sections of one of the members have upturned edges (not shown) which allow the other member to be precisely nested therein. The upturned edges may be left in the upright position or folded over the flange sections of the other member during assembly and ultimately bonded together, such as by furnace brazing processes to form an air tigh team in either instance.

Figure 4:
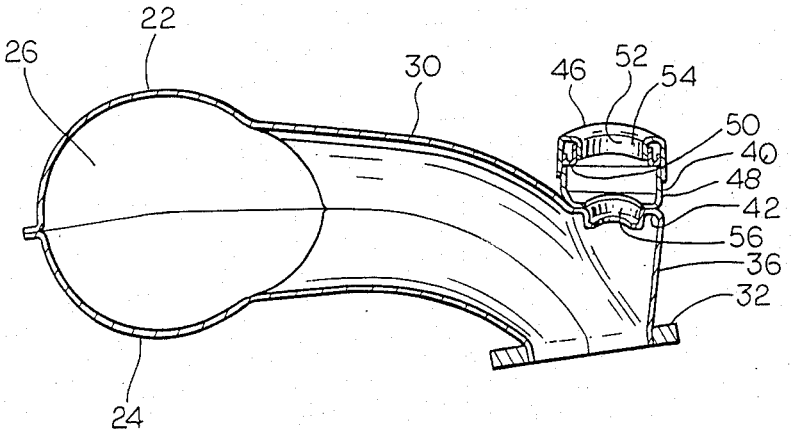
FIG. 4 is a sectional view taken along lines 4—4 of FIG. 1.

The flange sections 34 on opposites sides of the runners are in parallel planes which are angled slightly from lines normal to the plenum axis, for example 15 degrees towards the rear of the manifold as can be seen best in FIG. 1. They terminate at the manifold where short cylindrical extensions on the exit ends of the runners are tightly fitted into the ports of the manifold and bonded to the inside thereof. When viewed in a vertical cross section, as shown in FIG. 4, it will be noted that a typical runner decreases in size and is curved downwardly at an increased rate from its plenum end to its mounting plate end. A means for introducing fuel into the runners is provided adjacent to their mounting plate or exit ends. This means includes apertured nose sections 36 protruding from the top of each runner and a fuel injector rail assembly 40 mounted on these nose sections. Each nose section has a flat annular shoulder 42 surrounding a circular opening. The shoulder is disposed at an angle relative to the mounting plate and the circular opening is positioned such that an axial line projected through the center of the aperture perpendicular to the plane of the shoulder will pass through the outside half of the respective runner port 44 in the mounting plate 32.

Figure 2:
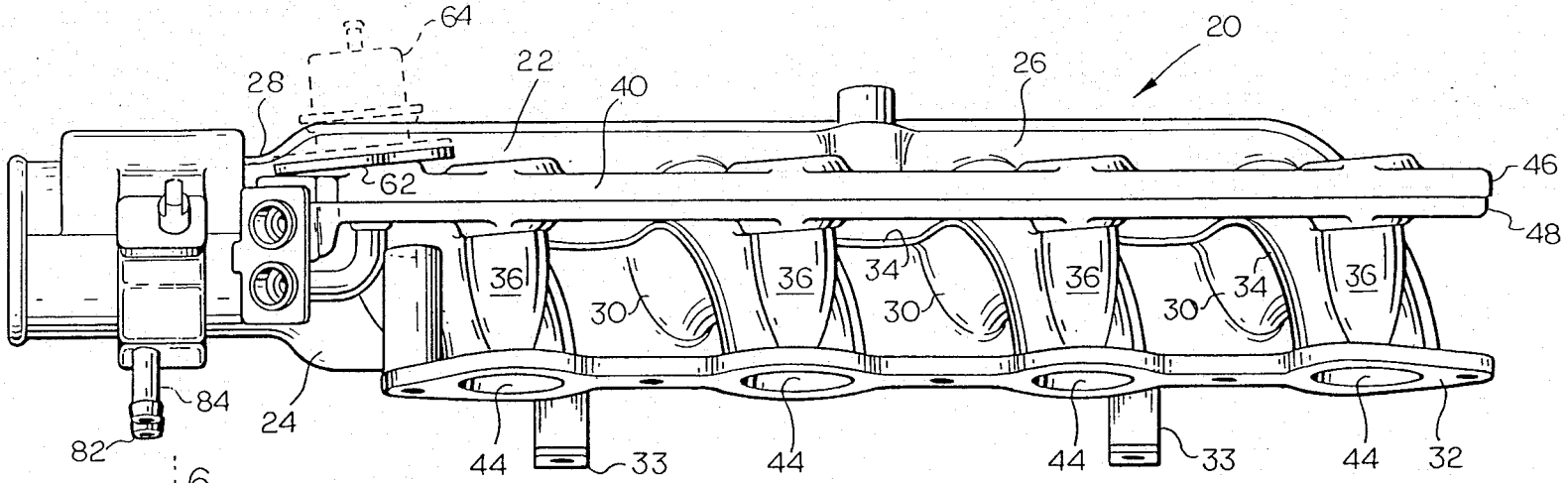
FIG. 2 is a side view of FIG. 1 taken from the fuel rail side of the manifold.

The fuel injector rail assembly 40 is comprised of elongated atop and bottom members 46, 48 having overlapping peripheral edges which are bonded together to form liquid tight seams and thus produce a hollow rail. An interior member 50 separates the inside of the fuel rail longitudinally into an upper run and a lower run. Portions of the top, bottom and interior members jointly define a plurality of fuel injector receptacles 52 each having an open top, and generally cylindrical upper and lower "O" ring seal seat sections 54, 56 axially displaced from each other by an annular opening for supplying fuel to the side of an injector (not shown). Preferably the lower seat sections 56 project through the nose section apertures with a limited clearance and have flat annular shoulders extending from their top ends in contact with the similar flat annular shoulders 42 of the nose sections 36 so that the fuel rail assembly can be precisely positioned on and sealingly bonded to the top portion of the manifold. The fuel injection rail could be removably attached to the manifold but preferably it is permanently affixed thereto. Fuel supply and return line connector fitments 58, 60 are attached to one end of the fuel rail so as to be in fluid communication with the lower and upper fuel runs respectively. A fuel pressure regulator mounting plate 62 is affixed to the top of the rail on the end of the rail adjacent to the connector fitments. A removable fuel pressure regulator 64 is shown in phantom lines in FIG. 2.

Figure 6:
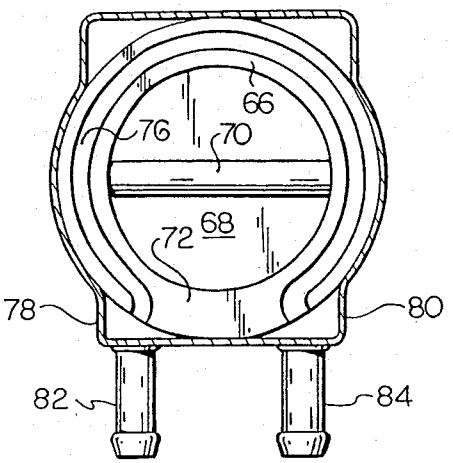
FIG. 6 is a sectional view taken along lines 6—6 of FIG. 5, and, FIG. 7 is a side view of the front portion of a modified intake manifold embodiment having a separate throttle valve body assembly attached to a foreshortened intake throat section of the manifold.
Figure 5:
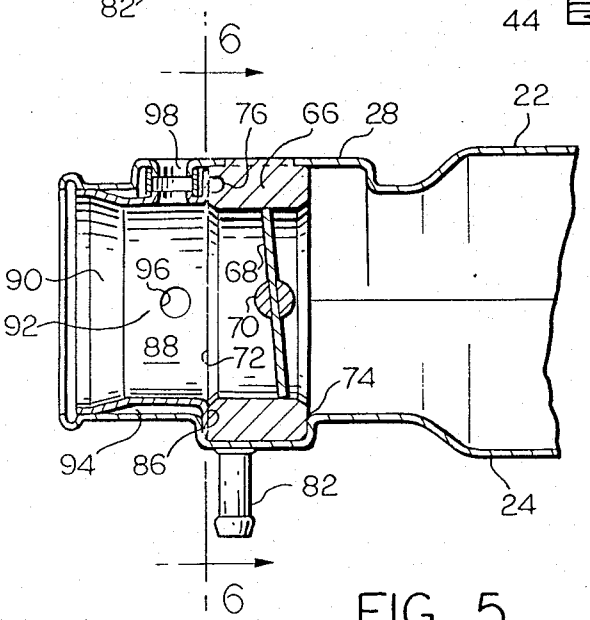
FIG. 5 is a sectional view taken along lines 5—5 of FIG. 1.
Figure 3:
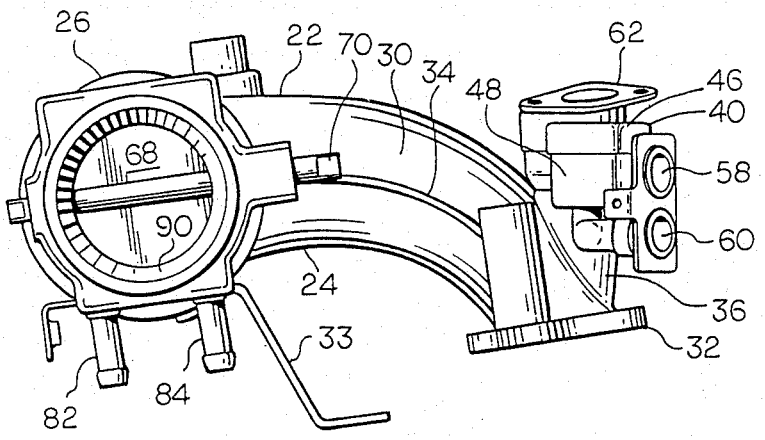
FIG. 3 is a front view of FIG. 1.

The throat section 28 of the manifold assembly is preferably integrally attached to the intake end of the plenum and contains a throttle valve assembly that includes a throttle valve body insert 66 which in turn contains a throttle plate 68 affixed to a rotatable shaft 70 extending laterally across the center of the throat opening (see FIGS. 3 and 5). The illustrated valve body insert 66 is generally cylindrical in form with a relatively thick wall and parallel front 72 and rear 74 end faces A frontal face portion as well as peripheral portions of the insert are exposed to a circulated heating fluid. For this purpose a discontinuous channel or groove 76 is provided in the front face end of the insert. The groove extends around at least the upper three quarters of the face from spaced apart inlet and outlet ends located adjacent to the bottom of the insert. (see FIG. 6) The groove ends are in fluid communication with respective left and right peripheral chambers defined by outer circumferential surface sections of the bottom of the insert and adjacent angular box sections 78, 80 of the surrounding sheet metal throat sections. Tubular inlet and outlet hose connectors 82, 84 are affixed to the outer bottom walls of the chambers so that heating fluid, such as radiator fluid or exhaust gases, may be circulated through the chambers and groove. The front side of the open groove in the face of the insert is closed by a tightly abutting laterally disposed annular flange 86 on the rear end of an entrance cone member or horn 88.

The entrance horn 88 has a venturi section 90 at its front end followed by a cylindrical section 92 of reduced diameter which merges with the coaxially aligned cylindrical section of the insert which in turn has an inside diameter of slightly further reduced size. Peripheral end portions of the horn 88 are sealed to the adjoining portions of the throat section and intermediate portions of the horn are spaced from the surrounding portions of the horn so as to define an annular chamber 94. A pair of fresh air by-pass openings 96 are located on opposite sides of the horn at the shaft level to provide fluid communication between the horn interior and the annular space so that by-pass air can be drawn from the interior of the entrance horn into the annular space and channeled around the throttle valve through a by-pass air control (not shown) whenever operating conditions warrant. A sealed passageway 98 for introducing crankcase fumes from a crankcase ventilating system (not shown) extends vertically through the top of the annular space from the outside of the throat section to the inside of the horn.

Figure 7:
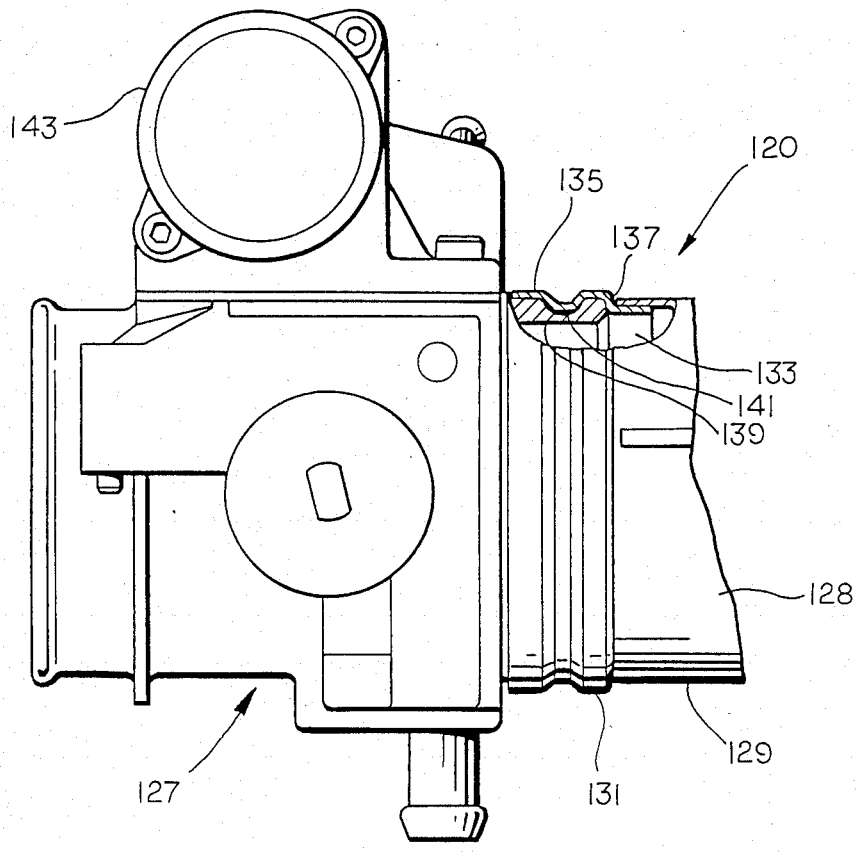

The intake manifold assembly 120 shown in FIG. 7 is functionally the same as the previously described embodiment 20 but differs structurally in that the throat section of the previous embodiment, including the throttle valve assembly components contained within it, is made as a separate intake throat and throttle valve assembly 127 and then attached to the complementary portion of the intake manifold. For this purpose a foreshortened throat section 129 with an open end is provided at the end of the plenum 128. An annular connecting collar 131 having a cylindrical male end 133 is fitted snugly in the open end of throat section 129 and sealingly bonded therein. The connector has a larger diameter cylindrical female end 135 joined to the male end by a radially disposed annular shoulder 137. A cylindrical male neck section 139 on the downstream end of a throttle valve assembly is fitted snugly inside the larger end of the connector and sealingly affixed therein. Preferably this is accomplished by providing an annular groove 141 on the outside surface of the neck, applying a bead or coating of anerobic elastomer sealant to the groove and then indenting a circumscribed portion of the connector into the groove. A state-of-the-art sensing and by-pass control module 143, which is not a part of this invention, is mounted on top of the intake and throttle valve assembly 127.

While the invention disclosed herein has been described and illustrated with respect to preferred embodiments, it is to be understood that modifications could be made to these embodiments without departing from the scope of the invention which is defined by the appended claims.

What is claimed is:

1. An improved intake manifold for an internal combustion engine, said manifold comprising: a ported mounting plate, at least two members made of sheet material defining an air intake throat section, a plenum section downstream from said throat section and a plurality of tubular runners extending from said plenum to said ported mounting plate said runners being attached at their outer ends to said plate, and a fuel injection rail having receptacles for holding a plurality of electromagnetic fuel injectors and supplying fuel to them, each of said receptacles being located above the mounting plate end of its respective runner and having an apertured bottom end in communication with the interior of said runner.

2. An improved intake manifold according to claim 1 wherein each of said receptacles has a cylindrical lower end which projects into the interior of its respective runner.

3. An improved intake manifold according to claim 1 wherein each of said runners has a nose section protruding from its top adjacent to its mounting plate end and said fuel rail is affixed to each of said nose sections.

4. An improved intake manifold according to claim 3 wherein each nose section has a flat annular top surface centered on a circular aperture which provides communication between the interior of said runner and said receptacle and said fuel rail is bonded to each flat annular surface.

5. An improved intake manifold according to claim 1 wherein each of said runners has an outer terminal end fitted into a respective port of said mounting plate and bonded therein.

6. An improved intake manifold according to claim 1 further including a throttle valve assembly insert contained in said throat section.

7. An improved intake manifold according to claim 6 wherein said throttle valve assembly insert has a front face and a channel on its fact for the circulation of a heating fluid.

8. An improved intake manifold according to claim 7 wherein peripheral portions and an end portion of said insert are exposed to heating fluid.

9. An improved intake manifold according to claim 7 further including an entrance horn contained in said throat section, said horn being disposed between said throttle valve assembly insert and the entrance of said throat section, said entrance horn having a lateral annular end flange abuting said front face of said insert.

10. An improved intake manifold according to claim 6 further including means for by-passing intake air around the outside of said insert, said means including an entrance horn contained in said throat section, said entrance horn being formed such that an annular space is defined by the outside of said horn and the inside of the surrounding throat section, and at least one aperture in said horn providing communication between said space and the interior of said horn.

11. An improved i take manifold according to claim 10 wherein said born insert has two by-pass apertures remotely spaced from one another.

12. An improved intake manifold according to claim 10 further including a sealed crankcase fumes inlet passageway extending through said annular space from an aperture in said throat section to a coaxially aligned aperture in said horn, said passageway being circumferentially positioned remotely from said by-pass aperture.

13. An improved intake manifold assembly for an internal combustion engine, said assembly comprising: top and bottom members made of sheet material, said members being joined by their edges and shaped so as to define an air intake throat section, a plenum a section downstream from said throat section and a plurality of tubular runners extending from said plenum to respective ports in a mounting plate affixed to the outer ends of said runners, and a throttle valve assembly insert contained in said throat section.

14. An intake manifold assembly for an internal combustion engine, said assembly comprising: top and bottom members made of sheet material, said members being joined by their edges and shaped so as to define an air intake throat section, a plenum section downstream from said throat section and a plurality of tubular runners extending from said plenum to respective ports in a mounting plate affixed to the outer ends of said runners, a throttle value assembly insert contained in said throat section, and an intake horn insert contained in said throat section and disposed upstream from said throttle valve assembly insert, said inserts jointly defining a passageway for circulating heating fluid.

15. An intake manifold assembly according to claim 14 wherein said passageway is defined by a groove in the front face of said throttle valve assembly insert and an abutting annular flange on the rear end of said horn insert.

16. An intake manifold assembly for an internal combustion engine, said assembly comprising: top and bottom members made of sheet material, said members being joined by their edges and shaped so as to define an air intake throat section, a plenum section downstream from said throat section and a plurality of tubular runners extending from said plenum to respective ports in a mounting plate affixed to the outer ends of said runners, a throttle valve assembly insert contained in said throat section, and means for by-passing intake air around the outside of said throttle valve assembly insert, said means including an entrance horn insert contained in said throat section upstream from said throttle assembly insert, said entrance horn being formed such that an annular space is defined by the outside of said horn insert and the inside of the surrounding throat section, and at least one aperture in said horn insert providing communication between said space and the interior of said horn insert.

17. An intake manifold assembly according to claim 16 wherein said horn insert has two circumferentially spaced apertures positioned remotely from one another.

18. An intake manifold assembly according to claim 16 further including a sealed crankcase fumes inlet passageway extending through said annular space from an aperture in said throat section to an aligned aperture in said horn insert, said passageway being circumferentialy positioned remotely form said by-pass aperture.

19. An intake manifold assembly for an internal combustion engine, said assembly comprising: top and bottom members made of sheet material, said members being joined by their edges and shaped so as to define an air intake throat section, a plenum section downstream from said throat section and a plurality of tubular runners extending from said plenum to respective ports in a mounting plate affixed to the outer ends of said runners, a throttle valve assembly insert contained in said throat section, and a fuel injection rail having a plurality of receptacles for holding a plurality of electromagnetic fuel injectors and supplying fuel to said injectors, said rail overlying the mounting plate ends of said runners and being integrally attached to said runners ends.

20. An intake manifold assembly according to claim 19 wherein the mounting plate end of each runner has an upwardly extending nose section with a flat annular top surface concentrically disposed with respect to a circular aperture which provides communication between the interior of said runner and said receptacle.

21. An intake manifold assembly according to claim 20 wherein said fuel rail receptacles each has a cylindrical bottom end which protrudes through said nose aperture.

* * * * *